United States Patent [19]

Podoprigora

[11] Patent Number: 4,599,826

[45] Date of Patent: Jul. 15, 1986

[54] DEVICE FOR MAGNETOABRASIVE MACHINING OF WORKPIECES

[75] Inventor: Georgy A. Podoprigora, Kiev, U.S.S.R.

[73] Assignee: Institut Sverkhtverdykh Materialov Akademii Naukukrainskoi SSR, Kiev, U.S.S.R.

[21] Appl. No.: 585,997

[22] Filed: Mar. 5, 1984

[51] Int. Cl.[4] ..... B24B 37/00; B24D 7/00

[52] U.S. Cl. ..... 51/71; 51/72 R; 51/109 R; 51/206 R; 51/209 R; 335/306

[58] Field of Search ..... 51/71, 72 R, 109 R, 51/209 R, 209 DL, 206 R, 362, DIG. 6; 335/303, 306

[56] References Cited

U.S. PATENT DOCUMENTS

| | | | |
|---|---|---|---|
| 588,441 | 8/1897 | Kann | 51/109 R |
| 3,601,730 | 8/1971 | Cookerly | 335/306 |
| 3,710,291 | 1/1973 | Nicoud | 335/306 |
| 4,222,204 | 9/1980 | Benner | 51/362 |

FOREIGN PATENT DOCUMENTS

| | | | |
|---|---|---|---|
| 546764 | 10/1957 | Canada | 51/209 |
| 185296 | 10/1963 | Sweden | 335/306 |
| 200489 | 10/1967 | U.S.S.R. | 335/306 |
| 315577 | 11/1971 | U.S.S.R. . | |
| 674874 | 7/1979 | U.S.S.R. . | |

*Primary Examiner*—Robert P. Olszewski

*Attorney, Agent, or Firm*—Fleit, Jacobson, Cohn & Price

[57] ABSTRACT

A device for magnetoabrasive machining of workpieces, comprising a carrier made of a nonmagnetic material and at least one permanent magnet made as a bank of at least four magnetic elements contacting one another with their side surfaces. The bank is situated on a respective magnetic circuit 5 secured on the carrier 1. The magnetic elements are so arranged in each bank that the polarity of their poles alternates staggerwise in the plane formed by said poles.

1 Claim, 11 Drawing Figures

DEVICE FOR MAGNETOABRASIVE MACHINING OF WORKPIECES

FIELD OF THE INVENTION

This invention relates generally to workpiece machining with ferroabrasive dusts in a magnetic field, and more specifically to a device for magnetically assisted abrasive machining of workpieces applicable largely for cleaning and polishing diversely shaped workpieces made of various materials.

BACKGROUND OF THE INVENTION

Magnetically assisted abrasive cleaning and polishing (hereinafter called 'magnetoabrasive machining' for brevity) is most efficient when applied to machining intricately shaped workpieces produced by die-forging, investment-casting, press-forming, or rolling, whereby the shape and size of a blank are maximally approximated to those of a finished product so that the latter needs only improvement in the surface roughness of the machined surface.

One prior-art device for magnetoabrasive machining of workpieces (cf., e.g., USSR Inventor's Certificate No. 315,577, Cl.B24b 31/10, 1971) is known to feature its magnetic system arranged on the same side as the workpiece surface being machined, with a clearance therebetween filled by a ferroabrasive dust. The magnetic system of the device consists of a cylinder whose end face carriers two coaxial ring-shaped unlike-polariry poles, and a magnetic coil fitted onto the inner pole. When the coil is energized a magnetic field is induced in the working clearance (magnetic air gap) which attracts the grains of the ferroabrasive dust to the ring-shaped poles. The majority of the abrasive grains become oriented across the ring-shaped poles to form a bridge therebetween, while but a minor part of the grains form a brushlike structure on the end face of the inner ring-shaped pole under which the coil turns are located. The aforesaid brush is arranged normally to the surface of the workpiece being machined. With the device receiving rotary motion and the workpiece reciprocating, the brush formed on the end face of the inner ring-shaped pole, polishes the workpiece surface.

However, workpiece machining with the afore-discussed device is unproductive and low-efficient since the value of magnetic induction in the machining zone is low and the force of pressing the ferroabrasive grains against the surface being machined is inadequate for the cutting process to occur. Moreover, some of the trains formed by the abrasive grains oriented lengthwise of the magnetic lines of force rotate together with the poles, while other grains remain on the surface on the workpiece being machined, thus impeding the machining process, affecting its productivity and causing premature wear of abrasive grains. All of this results in a badly deteriorated machining process.

In addition, the device mentioned above requires electric power to be supplied from an external source to establish a magnetic field, features a great mass and large-sized magnetic coils, which impairs the access to the working zone of the device, especially when machining small workpieces. Thus, the device will do only for machining large-sized workpieces.

To some extent the aforementioned disadvantages are eliminated in a device for magnetoabrasive machining of workpieces (cf., e.g., a USSR Inventor's Certificate No. 674,874, Cl.B24b 31/10, 1979), which comprises a carrier of a nonmagnetic material provided with a fixture for being held to the shaft of a rotary mechanism, and at least one permanent magnet located in a respective magnetic circuit fixed on a carrier.

The device considered above incorporates also another carrier positioned coaxially with the former one and carrying permanent magnets equal in number to those mounted on the former carrier.

One of the carriers carrying the magnetic circuit is fixed stationary, while the other carrier is turnable with respect to the former carrier. When in working position the permanent magnets of the carriers face one another with their unlike-polarity poles. When in nonworking position used for removal of the ferroabrasive dust from the surface of the working poles, the nonworking poles of the carrier-mounted permanent magnets are offset with respect to one another.

To effect machining the device in question is positioned with some clearance to the surface of the workpiece being machined and the clearance is filled with ferroabrasive dust. Then the device and workpiece are set in rotation and reciprocating motion, respectively. As a result, the ferroabrasive grains are entrained by the forces of the magnetic field established across the working poles of the device, to polish the surface of the workpiece being machined.

The magnets of unlike polarity in each of the carriers of the device are spaced apart from one another a distance equal to the diameter of the magnet, while the magnets of the stationary carrier are distant from the working gap for a length equal to the thickness of the movable carrier. Such an arrangement of the magnets extends the magnetic circuit, increases its resistance and magnetic dispersion flux, and reduces magnetic flux across the working gap. This means that normal forces Fmy pressing the grains of ferroabrasive dust against the magnet poles, and horizontal forces made up by radial components $Fmx_r$ and tangential components $Fmx_\tau$, are diminished. Once forces Fmy have been reduced part of the ferroabrasive grains slip with respect to the magnet poles, whereby the grains polish the surface of the poles rather than that of the workpiece being machined, which reduces the effective life of the ferroabrasive grains. When forces $Fmx_r$ are reduced this increases the amount of ferroabrasive grains expelled from the working gap by centrifugal forces, while reduction of the magnitude of forces $Fmx_\tau$ acting in the same direction as the cutting speed vector results in that ferroabrasive dust follows but unreliably the poles of the rotating carrier. As a consequence, ferroabrasive dust lags behind the rotating carrier with the poles and is displaced along the pole working surface in a direction opposite to the cutting speed vector, the working gap gets rid of ferroabrasive dust and the surface of the magnet pole becomes bare. Moreover, reduction of the magnitudes of forces Fmy, $Fmx_r$ and $Fmx_\tau$ effective in the working gap brings about reduction of the respective normal and tangential cutting force components. This, in turn, leads to badly affected productivity of the cutting process and its rapid damping.

SUMMARY OF THE INVENTION

It is an object of the invention to provide a device for magnetoabrasive machining of workpieces which will ensure higher productivity of the machining process.

The aforementioned object is accomplished due to the fact that in a device for magnetoabrasive machining of workpieces, comprising a carrier made of a nonmagnetic material and provided with a fixture for being held to the shaft of a rotary mechanism, and at least one permanent magnet located on a respective magnetic circuit fixed on the carrier, according to the invention each of the permanent magnets is essentially a bank of at least four magnetic elements contacting one another with their side surfaces, said magnetic elements being so arranged in each bank that the polarity of their poles lying on the axes of magnetization is in a staggered or alternating order.

It is practicable that in a device for magnetoabrasive machining of workpieces, according to the invention, all the banks of magnetic elements be so arranged on the end face of the carrier that the axes of magnetization of the magnetic elements should be in parallel alignment with the geometric axis of the carrier.

It is efficient that in a device for magnetoabrasive machining of workpieces, according to the invention, featuring a cylinder-shaped carrier, all the banks of magnetic elements be so arranged on the carrier inner or outer side surface that the axes of magnetization of the magnetic elements should make up the same angle with the carrier geometric axis, said angle being within 45 and 90 degrees.

It is expedient that the device for magnetoabrasive machining of workpieces should comprise a plurality of additional banks of magnetic elements equal in number to the main banks of magnetic elements, an additional cylinder-shaped carrier rigidly coupled to the main carrier, and a plurality of additional magnetic circuits equal in number to the additional banks and held in place on the inner or outer side surface of said additional carrier, said additional magnetic circuits carrying said respective additional banks of magnetic elements which are arranged similarly to the magnetic elements of the main banks. It is likewise favourable that the main and additional carriers be held in a spaced coaxial position with respect to each other and the unlike-polarity poles of the magnetic elements fastened on the outer and inner carriers should face the gap between the carriers and be arranged opposite each other, and that, with the axes of the magnetic elements of both the main and additional banks making up an acute angle with the geometric axes of the carriers, the outer carrier should have a slot for the workpiece to insert into the gap between the carriers.

It is also advantageous that the device for magnetoabrasive machining of workpieces have at least two banks of magnetic elements.

In the device for magnetoabrasive machining of workpieces, the magnetic field built up by the banks composed of magnetic elements which contact one another with their side surfaces and which are so arranged that the polarity of their poles alternates staggerwise, is in fact a nonuniform field. In said field magnetic leakage fluxes are minimized, since external magnetic flux of each of the magnetic elements is closed along a shortest magnetic circuit having lowest resistance. Concentration of a magnetic flux along the lines of junction of the individual magnetic elements into banks and that of the banks therebetween results in increased normal and tangential magnetic forces that acts upon the ferroabrasive grains in the course of the machining process, which adds to the productivity of the process.

BRIEF DESCRIPTION OF THE DRAWINGS

In order that the present invention may be more readily understood, various embodiments thereof will be described by way of example and with reference to the accompanying drawings, wherein.

DETAILED DESCRIPTION OF THE INVENTION

Figure 1:
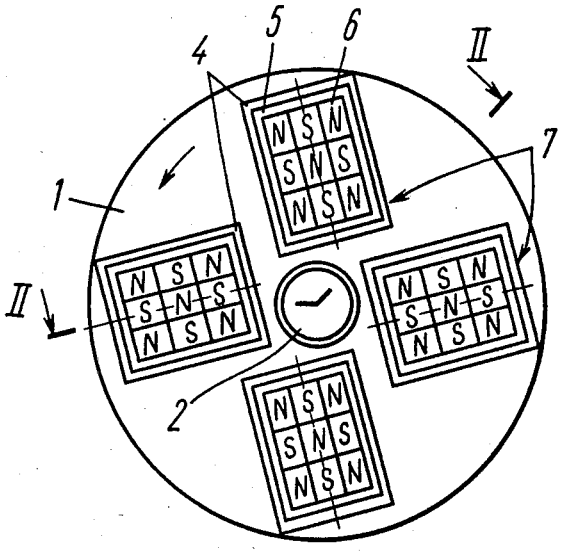
FIG. 1 shows a device for magnetoabrasive machining of workpieces having the banks of magnetic elements secured on the end face of a cylinder-shaped carrier, as viewed from the carrier end face, according to the invention.

The device for magnetoabrasive machining of workpieces comprises a carrier 1 (FIGS. 1, 2) made of a nonmagnetic material and press-fitted onto a taper shank 2 which is in fact a contrivance to be secured on the shaft of a rotary mechanism and is adapted to be clamped in the spindle of a metal-cutting machine (not shown). Holders 4 (FIGS. 1, 2) of a nonmagnetic material are equispaced peripherally on the end face of the carrier 1 which is cylinder-shaped in the embodiment under consideration, and are held in place by screws 3 (FIG. 2). The holders 4 are turnable about a vertical axis when setting up the device. Each of the holders 4 carriers a magnetic circuit 5 which is cemented to the holder in the considered particular embodiment of the device. The magnetic circuit 5 is adapted for closing magnetic leakage fluxes running off the inoperative poles of magnetic elements 6 and the side surface of a magnetic bank 7 as a whole, which is built up of at least four magnetic elements 6. As is clearly shown in FIG. 1, the magnetic elements 6 each have at least two adjacent intersecting side surfaces which are in contact with respective opposed side surfaces of two other ones of the magnetic elements and are so arranged in each bank 7 that the polarity of their N, S poles lying on the axes of magnetization (shown by a dash-dot line in FIG. 2), alternates staggerwise. In the embodiment under consideration the magnetic elements 6 of each bank 7 are rectangular in shape and are so arranged that their axes of magnetization are in parallel alignment with the geometric axis of the carrier 1.

Figure 2:
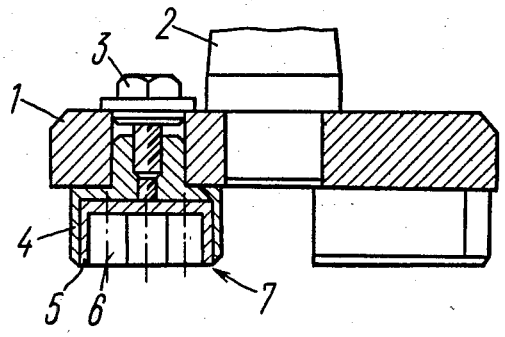
FIG. 2 is a section taken along the line II—II of FIG. 1, according to the invention.

As can be seen from FIG. 1 each of the magnetic elements 6 and the banks 7 of the magnetic elements 6 have one of their side surfaces in an angular position with the vector of the peripheral velocity of rotation of the device. This makes it possible to establish different angles of incidence of the ferroabrasive grains upon the micro-irregularities on the surface of the workpiece being machined, left by the preceding operation, which in turn adds to the productivity of the machining process.

Another embodiment of the device for magnetoabrasive machining of workpieces similar to that described above is also practicable.

Figure 3:
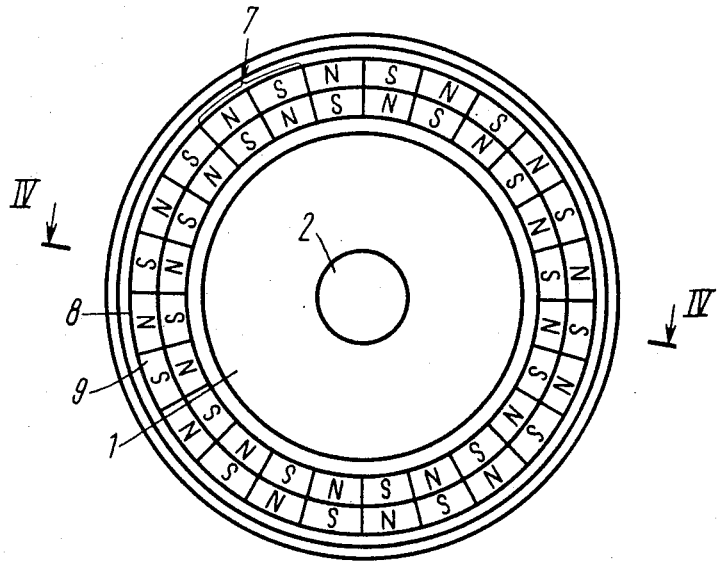
FIG. 3 is a view of the device of FIG. 1 having the banks of magnetic elements spaced circumferentially on the carrier, whose magnetic elements are in contact with the magnetic elements of the adjacent banks, according to the invention.
Figure 4:
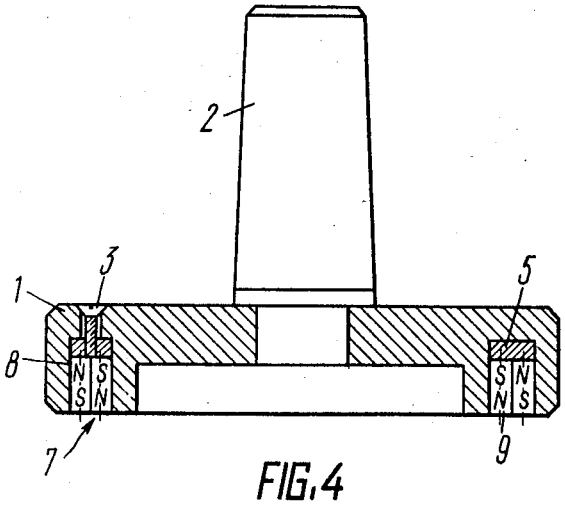
FIG. 4 is a section taken along the line IV—IV of FIG. 3, according to the invention.

The only difference of said embodiment resides in that an annular slot 8 is provided in the end face of the carrier 1 (FIGS. 3, 4), the geometric axis of said slot coinciding with the geometric axis of the carrier 1. The banks 7 are composed of magnetic elements 9 shaped as the segment of a circle and are accommodated in the annular slot 8 on the circular-shaped magnetic circuit 5.

In the embodiment of the device described herein the magnetic elements 9 of the adjacent banks 7 contact each other with their side surfaces, thus establishing an integrated circular magnetic system. Such an arrangement of the device enables machining with a circular tool formed by the magnetic field from ferroabrasive grains that produce abrasive effect upon any point on the surface of the workpiece being machined at the same speed, which renders the machining process more precise and adds to the quality of machining.

One more embodiment of the device for magnetoabrasive machining of workpieces similar to the above-discussed one is also possible.

The embodiment is dissimilar to that described above in that the banks 7 (FIGS. 5, 6) are constituted by magnetic elements 10 shaped as the segment of a circle. The magnetic elements 10 are situated on the outer side surface of the carrier 1 in such a manner that their axes of magnetization make the same angle with the geometric axis of the axis, said angle falling within 45 and 90 degrees. In the present embodiment of the device the axes of magnetization of the magnetic elements 10 are square with the geometric axis of the carrier 1.

The device having the banks 7 of magnetic elements situated on the outer cylindrical surface of the carrier 1 can be efficiently applied for uni- or bilateral machining of sheet materials. Moreover, a number of the individual magnetic carriers can be assembled into different-length rolls to suit the width of the workpiece being machined, while not disturbing the alternative arrangement of the poles of the magnetic elements 10 making part of the roll as a whole.

Figure 6:
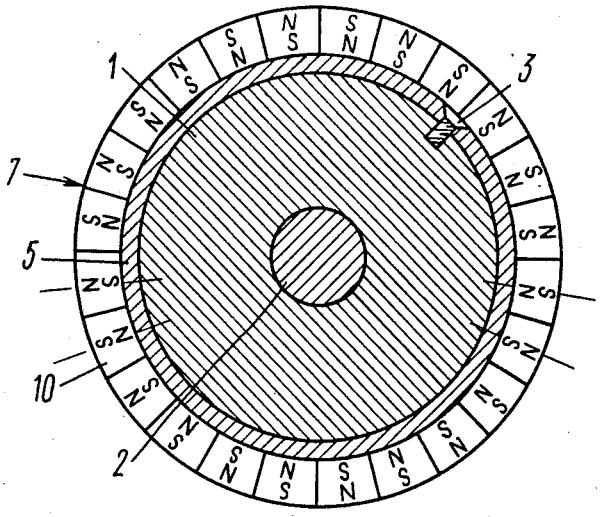
FIG. 6 is a section taken along the line VI—VI of FIG. 5, according to the invention.
Figure 5:
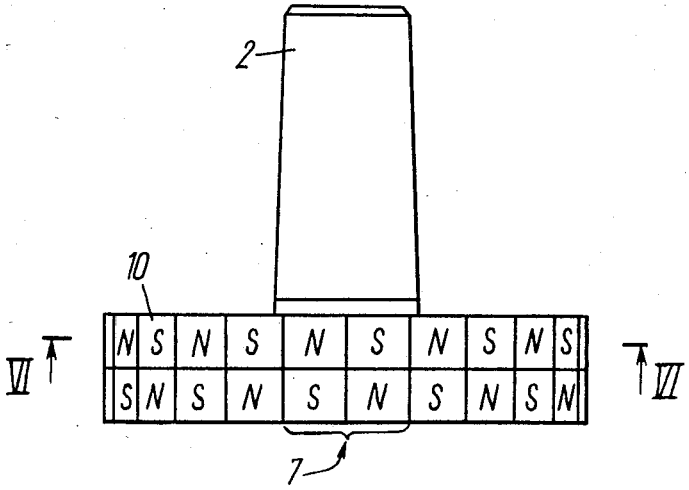
FIG. 5 is a general diagrammatic view of a device for magnetoabrasive machining of workpieces, having the banks of magnetic elements situated on the outer side surface of a cylinder-shaped carrier, according to the invention.
Figure 7:
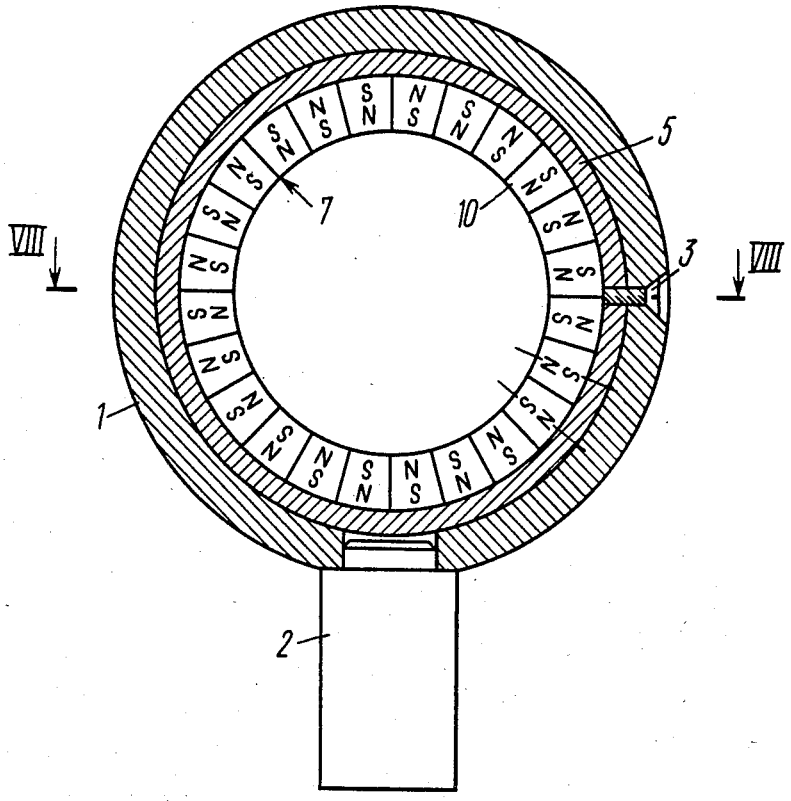
FIG. 7 is the view of a device of FIG. 5 having the banks of magnetic elements situated on the inner side surface of a carrier, according to the invention.
Figure 8:
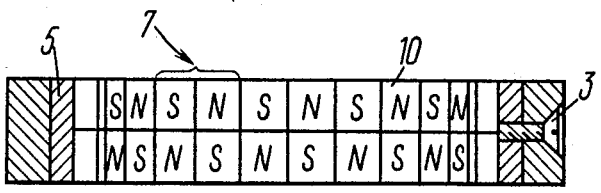
FIG. 8 is a section taken along the line VIII—VIII of FIG. 7, according to the invention.

Still one more embodiment of the device for magnetoabrasive machining of workpieces similar to that represented in FIGS. 5, 6 is also practicable, wherein the magnetic elements 10 (FIGS. 7, 8) are situated on the inner side surface of the carrier 1.

The device having the banks 7 of magnetic elements situated on the inner side surface of the carrier 1 is expedient to be applied for machining such workpieces as small-diameter bodies of revolution, wherein most efficient is the techniques by which the workpiece is encompassed by the magnetic system established by the banks 7.

Yet still more embodiment of the device for magnetoabrasive machining of workpieces is possible, which is in fact a combination of the embodiments represented in FIGS. 5 to 8.

Figure 10:
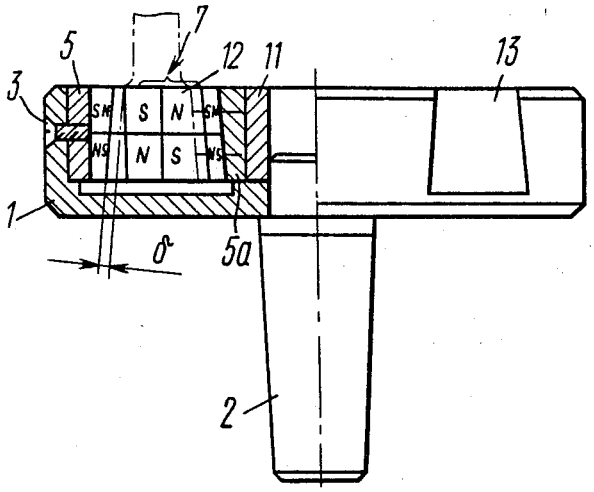
FIG. 10 is a section taken along the line X—X of FIG. 9, according to the invention.
Figure 9:
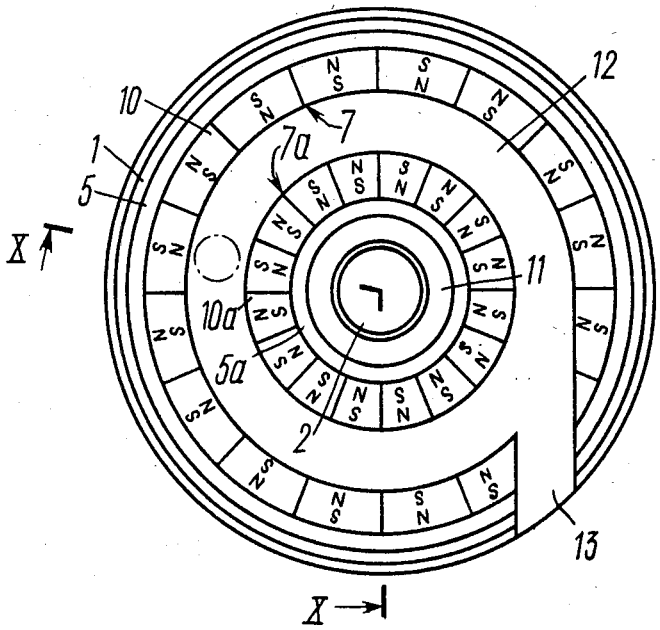
FIG. 9 is an alternative embodiment of a device for magnetoabrasive machining of workpieces, having two coaxial cylinder-shaped carriers and the banks of magnetic elements secured on the inner side surface of the outer carrier and on the outer side surface of the inner carrier in such manner that their axes of magnetization are at an acute angle as viewed from the end face of the carriers, according to the invention.

A distinguishing feature of the embodiment resides in that, with the purpose of machining tapered workpieces shown by a dot-dash line in the drawing, the cylinder-shaped carrier 1 (FIGS. 9, 10) with the banks 7 of the magnetic elements 10 situated on its inner side surface, accommodates a carrier 11 having banks 7*a* of magnetic elements 10*a* situated on its outer side surface on the magnetic circuit 5. The magnetic elements 10, 10*a* are so arranged that their axes of magnetization make the same acute angle with the geometric axes of the carriers 1, 11, thus defining a taper-shaped space 12 for the workpiece being machined to accommodate. In addition, the carriers 1, 11 are so arranged that the unlike-polarity poles of the magnetic elements 10, 10*a* of the outer and inner carriers 1, 11 are located opposite to each other.

A slot 13 is provided in the outer carrier 1 for the workpiece being machined to be placed in the space 12.

Such a constructional arrangement of the device enables magnetoabrasive machining in an annular magnetic bath, wherein the productivity of the machining process is substantially increased due to the fact that the entire workpiece surface being machined is immersed in ferroabrasive grains with which the annular space is filled.

For machining cylinder-shaped workpieces the annular space 12 and the slot 13 have a rectangular shape (not shown).

Figure 11:
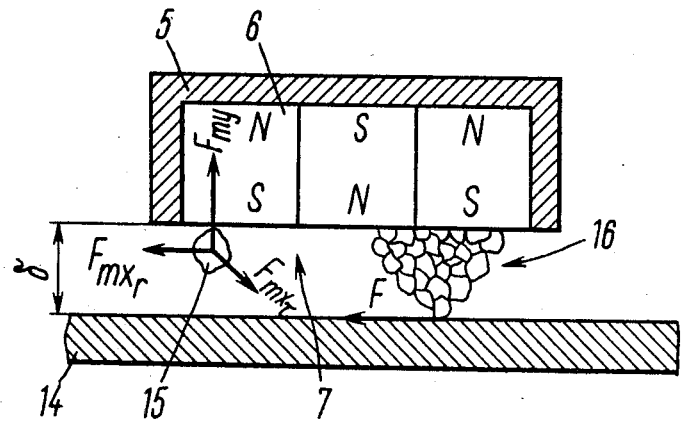
FIG. 11 is a schematic view of a bank of magnetic elements, positioned with a gap relative to the workpiece being machined, said gap being filled with ferroabrasive grains, and the directions of action of magnetic forces applied to every particular grain, according to the invention.

To promote understanding of the process of forming a tool possessing abrasive and magnetic properties, FIG. 11 represents the bank 7 of the magnetic elements 6 which is set with a gap $\delta$ with respect to the flat surface of a workpiece 14, said gap being filled with ferroabrasive grains 15 of which a cutting tool 16 is formed under the effect of magnetic field.

The device for magnetoabrasive machining of workpieces operates as follows.

Before commencing the operation the device is to be set up. To this end the screws 3 (FIGS. 1, 2) are undone, the holders 4 and the banks 7 of magnetic elements are turned in the direction of the cutting speed vector to an angle depending upon the lay of microirregularities on the surface of the workpiece as left by a preceding technological operation. Then the holders 4 are clamped by the screws 3 in a selected position with respect to the carrier 1, whereupon the device is set with its shank 2 into the spindle of a metal-cutting machine, e.g., a milling machine, while the workpiece being machined is set on the machine table through a diamagnetic pad. Next one should either elevate the table or move down the spindle with the device so as to attain a position in which the gap $\delta$ (FIG. 11) is left between the working surface of the banks 7 of magnetic elements and the surface of the workpiece being machined, the amount of said gap being three to eight times the size of the ferroabrasive grain 15 with which machining will be performed. Then the ferroabrasive dust is fed to the thus-established gap (which is in fact a magnetic air-gap) to be attracted to the working poles of the magnetic elements 6 of the banks 7. The magnetic field induced in the air-gap by the magnetic system proves to be nonuniform, and the amount of magnetic leakage fluxes is minimized, since the inoperative poles of the magnetic elements 6 facing inwards toward the holder 4 (FIGS. 1, 2), as well as the side surfaces of the elements 6 and of the banks 7, get closed on the magnetic circuit 5. Thereupon the device and the workpiece being machined receive rotation and reciprocation, respectively. The working poles of the magnetic elements 6 of the banks 7 entrain, by virtue of the magnetic field forces, the ferroabrasive grains 15 (FIG. 11) of the ferroabrasive tool 16 and impart to said grains a compound motion with respect to the surface of the workpiece. Thus, the process of magnetoabrasive polishing occurs. The ferroabrasive tool 16 reliably follows the poles of the magnetic system, since the latter is composed of a number of the individual magnetic elements 6 featuring alternatively arranged polarity. Concentration of the magnetic flux along the perimeter of the poles of each magnetic element 6, wherein the magnetic field acquires the maximum saturation due to an intimate contact with the side surfaces of the magnetic elements 6, and elimination, due to the aforementioned fact, magnetic leakage fluxes result in that the individual ferroabrasive grains 15 get arranged along the lines of magnetic flux to form a stiff brush. Every grain 15 making up said brush is acted upon by higher magnetic forces Fmy, $Fmx_r$ and $Fmx_7$, while the magnetic flux running off the working pole, i.d., the working surface of each magnetic element 6, is unifirmly distributed over the magnetic air-gap $\delta$.

Thus, the entire surface of the magnetic system is covered by a grate whose cells are clearly defined by the stiff brushes of the ferroabrasive grains 15, while each cell is filled with the ferroabrasive mass composed of the individual feroabrasive chains. Unlike the aforesaid brushes, the ferroabrasive chains are less stiff, and therefore they can deflect through some angle from the initial normal position during rotation of the device. As a result, the grain 15 contacting the surface being machined, may break off the chain, if the forces F of its friction against the surface being machined exceed the forces Fmy. Having become broken away from the chain the individual ferroabrasive grain 15 or a portion of the chain (floccule) is caused, by the centrifugal forces, to travel along the magnetic air-gap to the zone of higher magnetic flux density, thus making the brush arranged along the perimeter of the magnetic cell still closely packed; thereby dynamic wedging occurs. As a result, the normal and tangential components of the cutting force effective in said zone rise still more, and the productivity of the process increases. In addition, the individual ferroabrasive grains 15 and floccules, while performing relative motion inside the magnetic cell, stir the remaining bulk of the ferroabrasive dust located in the magnetic air-gap $\delta$. Thus, more and more fresh grains of the ferroabrasive dust from the deeply seated layers thereof get in contact with the surface being machined, the cutting elements of the grains 15 change their orientation, which contributes to self-sharpening of the grains 15 and adds to the productivity of the machining process. It is due to the provision of zones featuring higher magnetic flux density and uniformly distributed over the entire area of the magnetic system, that the aforementioned process proceeds on the entire area of the magnetic air-gap, which also adds to the productivity of the machining process and contributes to more reasonable utilization of the cutting properties of ferroabrasive dust and to more uniform machining of the workpiece surface.

By turning the holder 4 (FIGS. 1, 2) in the same direction with the cutting speed vector one can establish a variety of angles of incidence (within 30 and 60 degrees) of the ferroabrasive grains that form a stiff brush along the perimeter of each magnetic element 6, upon the surface microirregularities left on the surface being machined by the preceding operation. This in turn adds to the productivity of the machining process and also contributes to more intensive stirring of the ferroabrasive grains inside each magnetic cell.

Thus, the device of the invention has zones with higher magnetic flux density which are uniformly distributed over the working surface of the magnetic banks 7 lengthwise of the magnetic air-gap. This makes it possible to utilize magnetic energy of the system more efficiently and provides for higher productivity of the machining process.

The operation of the embodiments of the device as represented in FIGS. 3 to 10 is similar to that described above as far as the formation of a ferroabrasive tool by magnetic field is concerned. Every next embodiment of the device differs from the preceding ones only in its preoperative procedures concerned with an appropriate setting up of the magnetic air-gap between the workpiece surface being machined and the working poles of the magnetic elements 9, 10 making part of the banks 7.

To replace ferroabrasive dust or remove it from the working poles of the device use is made of a scraper made of a nonmagnetic material. When the device is pulled relative to the scraper which contacts the surface of the working poles, the used-up dust gets concentrated on a definite area of the device, wherefrom it is disposed of through a vacuum-suction extractor into the receiving bin.

Thus, the device of the invention is capable of a 1.3 to 1.5 fold increase in the productivity of the machining process, features small dimensions, is simple in construction and manufacture and is self-contained as requiring no external power supply. The device can find application in conjunction with any general-purpose metal-cutting equipment without any additional resetting thereof.

What is claimed is:

1. A device for magnetoabrasive machining of workpieces, obtaining drive from a rotary mechanism, and comprising:

a carrier of nonmagnetic material;

means for fixing said device on a shaft of said rotary mechanism, said fixing means being associated with said carrier;

at least one permanent magnet situated on said carrier and formed as a bank composed of a plurality of magnetic elements, at least four in number, each of said magnetic elements having an axis of magnetization and having at least two adjacent intersecting side surfaces contacting respective side surfaces of two other ones of said magnetic elements, said magnetic elements being so arranged in each of said banks that the polarity of their poles lying on the axes of magnetization, alternates staggerwise, and each of said banks of magnetic elements being mounted in a rotatable holder for changing the angular position of said bank of magnetic elements on the carrier with respect to a vector of peripheral velocity of said device; and magnetic circuits equal in number to said banks of magnetic elements, said magnetic circuits being secured on said carrier and carrying said banks of magnetic elements.

* * * * *